United States Patent [19]

Chapman

[11] 4,146,466

[45] Mar. 27, 1979

[54] APPARATUS FOR USE IN PRODUCING A FLUIDIZED BED OF GRANULAR MATERIAL

[75] Inventor: Roland P. Chapman, Redditch, England

[73] Assignee: British Leyland UK Limited, London, United Kingdom

[21] Appl. No.: 805,444

[22] Filed: Jun. 10, 1977

Related U.S. Application Data

[63] Continuation of Ser. No. 606,740, Aug. 21, 1975, abandoned.

[51] Int. Cl.[2] ..... B07B 11/06

[52] U.S. Cl. ..... 209/44; 209/467; 209/490; 425/6; 427/185

[58] Field of Search ..... 366/101; 209/44, 246, 209/259, 466, 467–469, 490, 494; 34/10, 57 R; 259/DIG. 17; 222/162, 405; 23/288 M, 288 S; 427/185, 213; 118/603, 610, 429; 425/6–10

[56] References Cited

U.S. PATENT DOCUMENTS

| | | | |
|---|---|---|---|
| 951,097 | 3/1910 | Allison | 222/162 X |
| 1,594,901 | 8/1926 | Geer | 222/162 X |
| 2,203,840 | 6/1940 | Perkins | 23/288 M |
| 2,702,635 | 2/1955 | Bowen | 209/466 |
| 2,921,335 | 1/1960 | Bowers | 425/10 |
| 3,043,652 | 7/1962 | Schytil | 23/288 S X |
| 3,216,125 | 11/1965 | Dennert | 34/57 R |
| 3,345,181 | 10/1967 | Smith | 259/DIG. 17 |
| 3,349,912 | 10/1967 | Eveson | 209/11 |
| 3,427,008 | 2/1969 | Geoffroy | 34/10 |
| 3,518,777 | 7/1970 | Kono | 34/10 X |
| 3,567,485 | 3/1971 | Lemelson | 427/185 |
| 3,726,621 | 4/1973 | Gehy | 425/6 |
| 3,832,974 | 9/1974 | Adams | 118/DIG. 5 |
| 3,879,855 | 4/1975 | Weiser | 34/57 R |

FOREIGN PATENT DOCUMENTS

| | | | |
|---|---|---|---|
| 697316 | 11/1964 | Canada | 259/DIG. 17 |
| 1143461 | 2/1963 | Fed. Rep. of Germany | 209/468 |
| 1087841 | 9/1954 | France | 209/469 |
| 1184738 | 3/1970 | United Kingdom | 34/57 R |

*Primary Examiner*—Robert Halper
*Attorney, Agent, or Firm*—Brisebois & Kruger

[57] ABSTRACT

A fluidizing tank for granular refractory material has a porous bottom wall that is displaceable downwardly from a bottom edge of the tank in order to define a gap through which contaminating precipitated particles can fall from the tank, preferably aided by a downward slope of the porous wall. A receptacle housing the tank contains a vibratory sieve for separating the particles from the material falling from the tank so that the sieved material may be returned to the tank, preferably directly by mechanical or suction transfer from the bottom of the receptacle.

6 Claims, 1 Drawing Figure

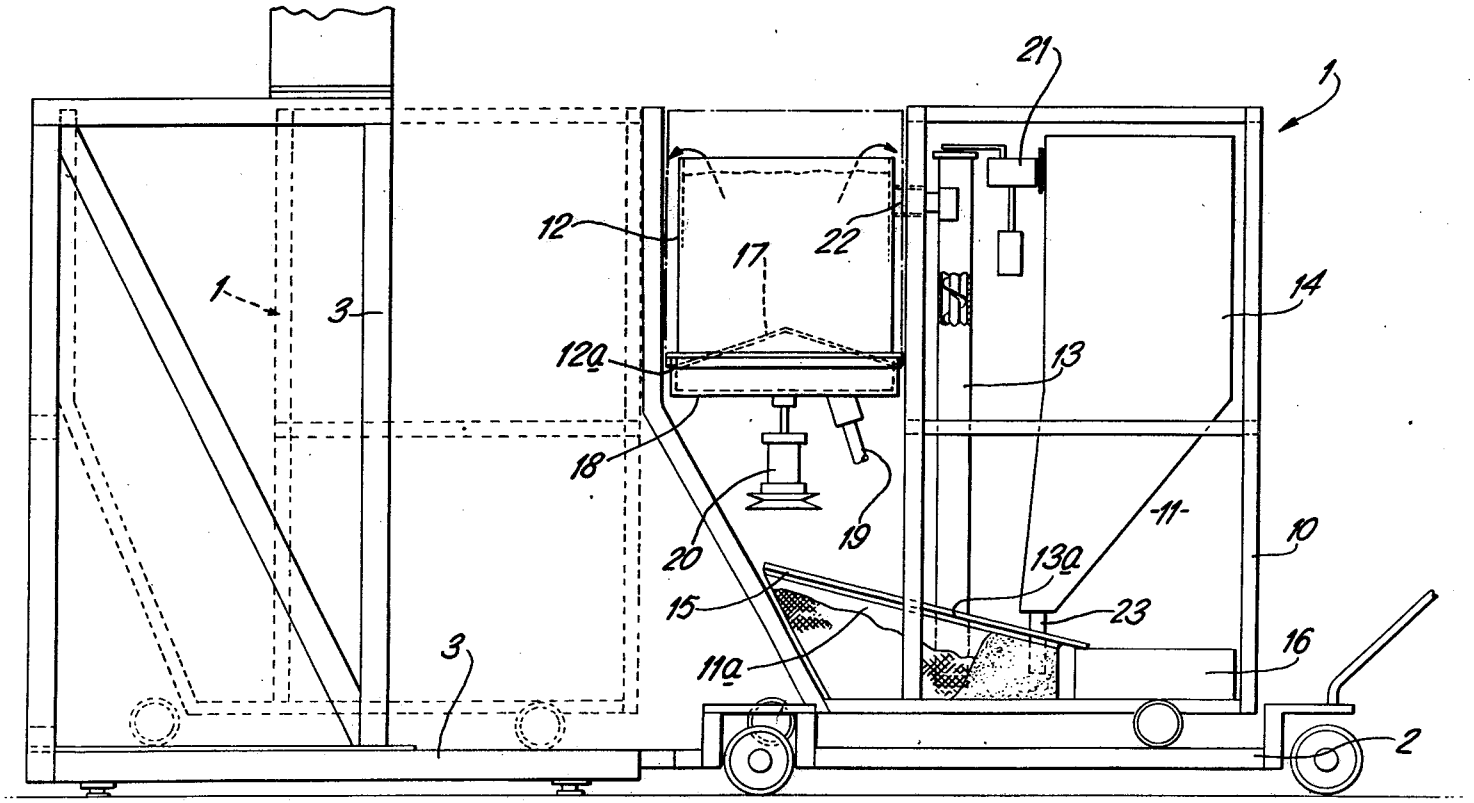
1
14
10
16
2
11
23
13a
13
21
22
19
17
20
15
11a
12
12a
18
3
3
1

APPARATUS FOR USE IN PRODUCING A FLUIDIZED BED OF GRANULAR MATERIAL

This is a continuation of application Ser. No. 606,740, now abandoned, filed Aug. 21, 1975.

This invention relates to apparatus for use in producing a fluidised bed of granular material, such apparatus including a fluidising tank the bottom wall of which is formed by a porous wall of a plenum chamber. One use of such apparatus with which the invention is particularly concerned is in the production of shell moulds of the lost-pattern type for precision casting.

Typically, a lost-pattern shell mould is produced by dipping a disposable, eg. wax, pattern alternately in a refractory slurry and a fluidised bed of refractory material so that the wall of the mould is built up progressively on the pattern. Automation of this process gives rise to numerous problems not least among which is the contamination of the fluidised bed with droplets of the slurry carried over to it on the patterns. There is, moreover the problem of constantly replenishing the fluidised bed as it becomes depleted by successive dippings of the patterns.

The present invention is aimed at facilitating the removal of the contaminating particles and to this end resides in apparatus having the features referred to above, wherein the plenum chamber together with the porous wall is mounted for downward displacement from a bottom edge of the tank in order to define a gap through which precipitated particles can fall from the tank.

Since the contaminating particles are generally heavier than the individual grains of the refractory material, they tend to precipitate to the bottom of the tank. Thus, the contaminating particles are among the material that first leaves the tank via the gap upon the downward displacement.

As a further inducement to the particles to leave the tank, the porous wall is preferably inclined from the horizontal downwardly towards the portion thereof that defines the gap with the bottom edge of the tank. Thus, the precipitated particles tend to accumulate next to the side wall forming the bottom edge of the tank so that they are positioned to leave the tank through the gap in advance of any other material.

In order to minimise the frequency of the displacements necessary to release the contaminating particles from the tank, a construction is preferred in which the porous wall presents a convex surface to the interior of the tank and, upon said displacement, defines a substantially annular gap with the bottom edge of the tank. Such a construction allows the tank to tolerate a substantial build-up of contaminating particles therein before its fluidising action is adversely affected, and requires only a relatively small displacement of the plenum chamber to form a gap of large area. Preferred convex surfaces for the porous wall are either conical, or pyrimidal.

To avoid wastage of the granular material that falls from the tank with the contaminating particles through the gap, a construction is preferred in which the plenum chamber is housed together with the tank in a receptacle for material falling from the tank, and a vibratory sieve is interposed between the plenum chamber and the bottom of the receptacle for separating contaminating particles from the material. The sieve is preferably inclined downwardly towards a waste collection point, for example, a removable waste bin.

The sieved material collected in the bottom of the receptacle can be recovered manually, but preferably material transfer means, for example, a screw conveyor or suctionfeed arrangement, is provided to return the sieved material from the bottom of the receptacle to the tank.

The granular material in the tank can be continuously replenished in operation and may, for example be allowed to cascade over the top edge of the tank into the above-described receptacle. Conveniently, a hopper is provided for feeding supplementary granular material into the bottom of the receptacle, for transfer to the tank. The feed from the hopper preferably operates on the immersed nozzle principle.

Apparatus according to the invention can be of modular construction, that is to say it can comprise a unit that can be slid or wheeled into its operating position in a shell mould producing plant. Thus, the apparatus may be interchanged with a like unit for servicing, without halting the operation of the plant.

A preferred embodiment of the invention will now be described, by way of example only, with reference to the accompanying drawing which is a schematic side elevation of a fluidised bed refractory dip station adapted for use in a lost-pattern shell mould producing plant.

Referring to the drawing, the apparatus embodying the invention is designated generally by the reference numeral 1. As shown, it is wheeled unit carried on a trolley 2 from which it can be readily trundled into its operating position (shown in broken outline) on a base frame 3 of the shell mould producing plant.

The unit 1 itself comprises a chassis 10 clad with walls (near one removed for the purpose of illustration) which form a receptacle 11 that encloses a fluidising tank 12, a screw conveyor 13, a hopper 14, an inclined vibratory sieve 15 and a removable waste bin 16.

The bottom of the fluidising tank 12 is formed by a porous-conical fluidising tile 17 supported on and forming the upper wall of a circular cylindrical plenum chamber 18 that has an inlet 19 for connection to a source of compressed air. The plenum chamber 18 together with the fluidising tile 17, is centrally mounted on a vertically acting pneumatic actuator 20 by which it is held in the position illustrated, such that the tile 17 forms the bottom wall of the fluidising tank 12 in abutment with a bottom edge **12*a*** of the tank.

When it is required to clear the fluidising tank 12 of contaminating particles, the plenum chamber 18 and tile 17 are displaced downwardly from the bottom edge **12*a* of the tank 12 by means of the actuator 20, so that an annular gap is formed through which the material can drop from the tank 12 onto the sieve 15. The sieve 15 is vibrated continuously in its own plane by means of a vibratory motor drive (not shown) in order to facilitate both the descent of contaminating particles into the waste bin 16 and the passage of re-usable granular material therethrough into a compartment 11*a* in the bottom of the receptacle 11**.

The screw conveyor 13 is driven continuously by a motor 21 and extends vertically between the compartment **11*a* and a horizontal feed duct 22 that opens through the side of the tank 12. The screw conveyor 13 passes through an opening in the sieve 15 in relation to which it is sealed by a flexible diaphragm seal 13*a* that accommodates the vibration of the sieve. The rate of feed afforded by the screw conveyor 13 is such that the granular material continuously overflows the top edge of the fluidising tank 12 and drops into the compartment 11***a* by way of the sieve 15.

Since granular material leaves the fluidised bed on the successively dipped patterns it is necessary to replenish the reservoir compartment with fresh material. This is achieved by means of the hopper 14 which has an outlet nozzle 23 that passes through the sieve 15, in a sealed relationship therewith like the screw conveyor 13, and is immersed in the granular material in the reservoir compartment. Thus, the compartment 11*a* is automatically replenished with fresh granular material from the hopper 14 on the gravity-feed immersed-nozzle principle.

What we claim is:

1. A fluidised bed pattern coating apparatus for producing shell moulds of the lost-pattern type for precision casting, said apparatus including a fluidised bed of granular pattern coating material contained in a tank and a plenum chamber associated therewith, and in which contaminating particles are produced and precipitated during coating of patterns on the tank, the improvement according to which the bottom wall of said tank comprises a porous wall of said plenum chamber through which gas is introduced into said tank to fluidise substantially all of the pattern coating material forming said bed, and means mounting the plenum chamber together with the porous wall for downward displacement from a bottom edge of the tank to form a gap through which said contaminating particles produced and precipitated during coating of patterns in the fluidised bed fall from said tank, and through which gap granular material falls from the tank with the contaminating particles, and wherein the plenum chamber is housed together with the tank in a receptacle for the materials falling from the tank, and a vibratory sieve is interposed between the plenum chamber and the bottom of the receptacle for separating said contaminating particles from said granular material which falls from the tank with the contaminating particles.

2. Apparatus according to claim 1, wherein the porous wall is inclined from the horizontal downwardly towards the portion thereof that defines the gap with the bottom edge of the tank.

3. Apparatus according to claim 2, wherein the porous wall presents a substantially convex surface to the interior of the tank and, upon said displacement, defines a substantially annular gap with the bottom edge of the tank.

4. Apparatus according to claim 1 wherein material transfer means is provided to return sieved granular material from the bottom of the receptacle to the tank.

5. Apparatus according to claim 4, wherein a hopper is provided for feeding supplementary granular material into the bottom of the receptacle, for transfer to the tank.

6. Apparatus according to claim 1 wherein said mounting means mounts the plenum chamber together with the porous wall for alternate downward displacement from the bottom edge of said tank to form said gap, and upward displacement to the bottom edge of the tank to close said gap.

* * * * *